US006345834B1

(12) United States Patent
Bianchini et al.

(10) Patent No.: US 6,345,834 B1
(45) **Date of Patent: *Feb. 12, 2002**

(54) RECREATIONAL SNOWBOARD

(75) Inventors: Emanuele Bianchini, Charlestown; Kenneth B. Lazarus, Boston; Jeffrey W. Moore, Arlington; Robert N. Jacques, Hopkington; Jonathan C. Allen, Brookline, all of MA (US)

(73) Assignee: Active Control eXperts, Inc., Cambridge, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/957,839

(22) Filed: Oct. 27, 1997

Related U.S. Application Data

(63) Continuation-in-part of application No. 08/536,067, filed on Sep. 29, 1995, now Pat. No. 5,857,694.

(51) Int. Cl.[7] ..... A63C 5/075

(52) U.S. Cl. ..... 280/602; 280/14.1; 310/317; 310/326

(58) Field of Search ..... 280/602, 601, 280/609, 610, 14.21; 310/317, 326, 328, 327; 473/282, 318, 316, 521, 520

(56) References Cited

U.S. PATENT DOCUMENTS

| | | | | |
|---|---|---|---|---|
| 4,565,940 A | 1/1986 | Hubbard, Jr. | ..... | 310/326 |
| 4,849,668 A | 7/1989 | Crawley et al. | ..... | 310/328 |
| 5,315,203 A | 5/1994 | Bicos | ..... | 310/326 |

(List continued on next page.)

FOREIGN PATENT DOCUMENTS

| | | | | |
|---|---|---|---|---|
| DE | 250203 | 7/1976 | ..... | 280/602 |
| EP | 0162372 | 11/1985 | ..... | 280/602 |
| FR | 2643430 | 8/1990 | ..... | 280/602 |
| SE | 0465603 | 10/1991 | | |

*Primary Examiner*—Anne Marie Boehler
(74) *Attorney, Agent, or Firm*—Testa, Hurwitz & Thibeault LLP

(57) ABSTRACT

A recreational board such as a snowboard incorporates strain transducers to damp a plate resonance of the board. The strain transducers are preferably located around a peripheral region to capture strain energy affecting control edges, for example steering control edges at the front and/or rear of the board. Electrical energy from the transducers is shunted to damp a targeted resonance. In a preferred embodiment the strain transducers cover a region of the snowboard adjacent one surface and extending along the forward periphery, preferably at both inside and outside edges, and are shunted with a resonant shunt tuned to a torsional or torsion-like mode of the board that is excited during steering maneuvers. The transducers may be fabricated as preassembled sheets or may be formed in the snowboard during the assembly process using sheets of piezoceramic material, or using piezo fiber or other composite constructions. The strain material may be positioned to preferentially shift or damp one resonance mode, and/or it may be arranged to exert a directional effect or anisotropic control authority. A passively operated embodiment employs a simple resistive shunt to enhance control of strain energy at the frequency of a resonant mode of the snowboard. Damping of that mode reduces chatter of the steering edges in use. The strain elements may be used in conjunction with viscoelastic or other damping mechanisms to tailor the overall level of mechanical control and limit the allowed excitations of the board.

16 Claims, 8 Drawing Sheets

U.S. PATENT DOCUMENTS

| | | | | | |
|---|---|---|---|---|---|
| 5,390,949 | A | | 2/1995 | Naganathan | 280/707 |
| 5,499,836 | A | | 3/1996 | Juhasz | 280/602 |
| 5,590,908 | A | | 1/1997 | Carr | 280/601 |
| 5,615,905 | A | | 4/1997 | Stepanek et al. | 280/602 |
| 5,645,260 | A | | 7/1997 | Falangas | 248/550 |
| 5,647,353 | A | * | 7/1997 | Juhasz | 280/602 |
| 5,656,882 | A | * | 8/1997 | Lazarus et al. | 310/328 |
| 5,674,135 | A | * | 10/1997 | Franco et al. | 280/602 |
| 5,775,715 | A | | 7/1998 | Vandergrift | 280/602 |
| 5,775,716 | A | * | 7/1998 | Harsanyi et al. | 280/602 |
| 5,857,694 | A | * | 1/1999 | Lazarus et al. | 280/602 |

* cited by examiner

LABORATORY TESTING OF SNOWBOARD WITH AND WITHOUT PIEZOELECTRIC DAMPING DEVICE

RECREATIONAL SNOWBOARD

REFERENCE TO RELATED APPLICATION

This application is a continuation-in-part of U.S. patent application Ser. No. 08/536,067 filed on Sep. 29, 1995 and entitled Adaptive Sports Implement, now U.S. Pat. No. 5,857,694. That patent application is hereby incorporated herein by reference in its entirety.

BACKGROUND OF THE INVENTION

The present invention relates to snowboards and related recreational devices. In particular, it relates to an improved construction of such a device to reduce the overall level of vibration or chatter and enhance its control, thereby substantially enhancing the performance of the device as well as its safety of use. In certain aspects the invention applies to related devices such as toboggans, water skis and runnerless sleds, and to a family of wide ski-like recreational articles, such as telemark or stunt skis.

A snowboard as commonly understood is a relatively flat, elongated sliding platform upon which a user rides upright, in the manner of a ski, sliding and turning for recreational purposes. Generally, snowboards are used on downhill ski slopes, and the board itself has the general size and shape of a water ski, about 1.25 by 0.25 meters, approximately halfway between the dimensions and shapes of a downhill ski, and a sled or toboggan. A snowboard differs from a pair of skis in several important respects. Namely, it has a single elongated sliding surface, rather than a pair of surfaces, and it is controlled by the action of shifting weight with both boots bearing on the single board rather than separately steering or allocating weight between two narrow skis. Furthermore, a snowboard is generally constructed so that its bending stiffness is less than that of a ski. This softness allows the board to be controlled fairly easily by feel, rather than requiring skilled technical training, since it allows slight shifts in weight to effect noticeable differences in the ground-engaging surface that effects steering and braking.

In practice, one boot of the wearer is generally in a mount positioned nearer to the front of the board, and the second boot is mounted somewhat behind the first, allowing the user to shift his weight distribution between the two positions and lean one way or another on the central weight-bearing region. By shifting weight between feet and altering the direction of bearing of the load, the user effects varying amounts of drag or frictional sliding against the bottom surface, and also changes the engagement of edges with the snow, allowing the board to be steered much like a water ski as if it were riding against a fluid surface, and also like a downhill ski that bites at its edges to control the direction of motion. While precise speed and steering control characteristics vary depending on the nature of the underlying snow and the terrain upon which the board is traveling, and are highly individual or intuitive in the ensemble, in general by evenly distributing the weight the board is made to glide faster while by leaning to make the direction of bearing off-vertical or by redistributing weight, the board may be made to steer to one side or the other, or to effect a braking drag and reduce its velocity.

The foregoing principles of operation apply equally well to basic or rudimentary embodiments of a snowboard, such as the dining hall trays often used by children in lieu of sleds, and to the more advanced consumer products often made of advanced materials and having special characteristics of surface friction, shape, stiffness and strength. Indeed, the more advanced consumer products are engineered to attain quite high speeds and achieve reasonable steering and control at these velocities. However, mechanically speaking, a snowboard is a plate, a two-dimensional sheet of material. As such, running in contact with the ground's surface, it is subject to a number of induced vibrations or resonances. Because their construction is relatively flexible, these states may result in significant chatter at higher speeds as driving forces are exerted on the plate. While in general objectionable oscillations of the snowboard can be limited by simply traveling at low to moderate speeds along gentle surface conditions, a snowboard is more fun and physically challenging to use at higher speeds in exotic or more rugged terrains. Under highly stressed conditions, the driving forces may quickly introduce chatter which impairs steering and may render even simple sliding motion less efficient. Indeed, with snowboards it is not uncommon for a user to generate a great deal of noise and vibration even while traveling at a relatively low speed. As the user progresses to higher speeds and other control maneuvers, structural vibration of the snowboard may introduce instabilities, or inefficiencies or defects of control.

Thus, it would be desirable to provide a snowboard in which structural vibration is better controlled.

It would also be desirable to provide such a snowboard in which desirable characteristics of stiffness, weight and size are maintained while improving overall damping.

SUMMARY OF THE INVENTION

These and other desirable ends are obtained in a snowboard having a generally elongated sheet body extending over a two-dimensional region and defining a sliding surface. A central portion of the sheet body supports the user, and the body extends forwardly, rearwardly and laterally outward of the central portion to its bounding edge. Strain elements are positioned adjacent the top surface near the edge to capture strain energy distributed in an anterolateral portion of the board. The strain elements transduce this energy to electrical energy, which is shunted so as to damp the structure. In one embodiment, the strain elements are distributed in sheets having a surface area of about 10–200 $cm^2$ and a thickness under approximately two, and preferably under one millimeter. Preferably, the strain elements are shunted by a resistive shunt, or a combination of a resistive shunt with one or more other elements such as inductive or capacitive elements, calculated to define a resonant circuit for the electrical charge at a target frequency. The target frequency in turn may be a frequency which is measured, or which is computed from the geometric dimensions and stiffness or other physical characteristics of the snowboard, to be a plate resonance of the board. In a practical example for one model of snowboard, the shunt is tuned to a resonance band about 60 Hz and controls a torsion-like oscillation of high amplitude that affects engagement of the steering edge of the board.

BRIEF DESCRIPTION OF THE DRAWINGS

These and other features of the invention will be understood from the description which follows, including the drawings illustrating details of the structure and operation of a snowboard embodiment, wherein.

DETAILED DESCRIPTION

Figure 1:
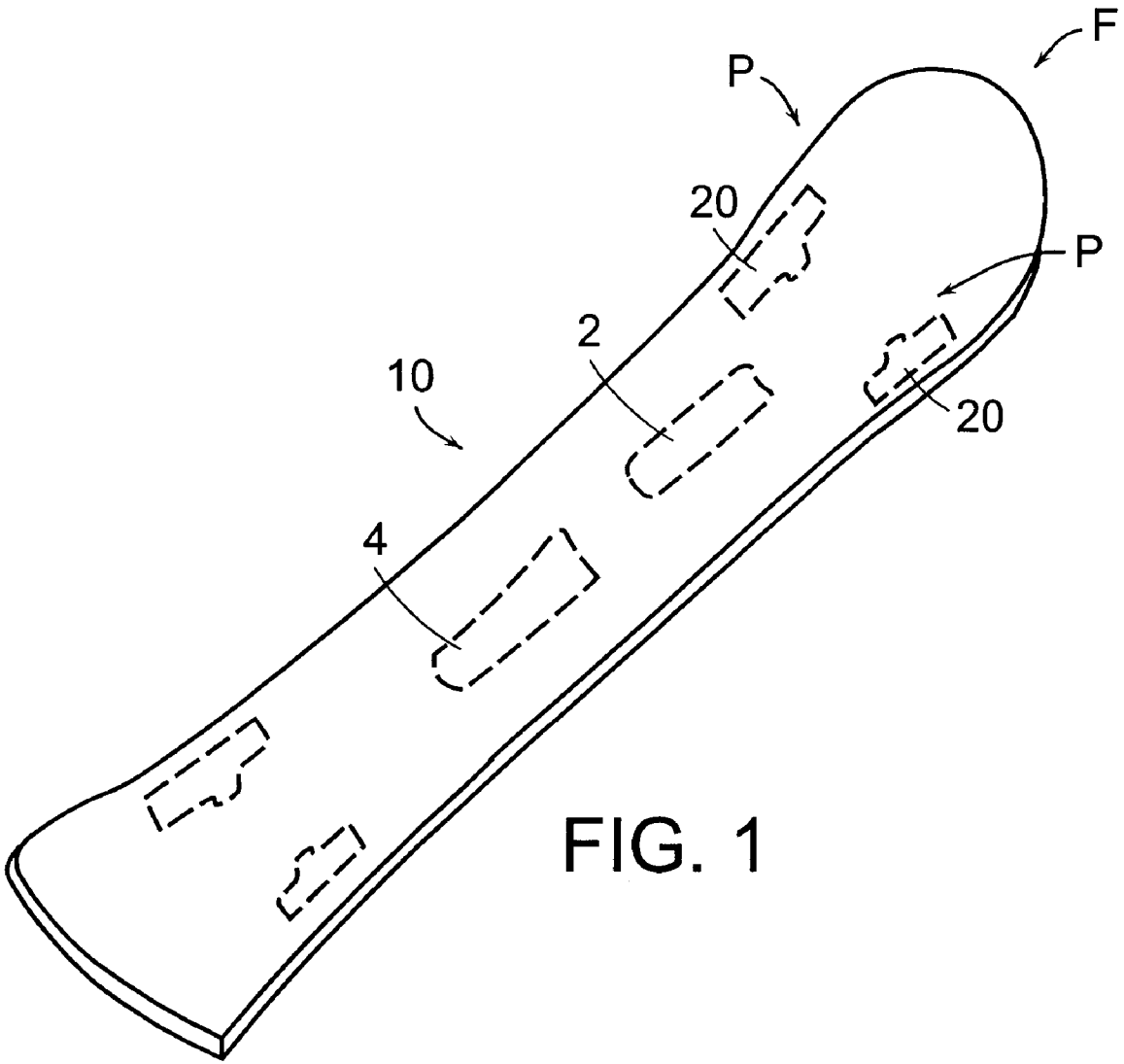
FIG. 1 illustrates a snowboard in accordance with the present invention.

FIG. 1 shows a snowboard 10 constructed in accordance with the present invention. Snowboard 10 has a generally elongated body which in a typical construction flares slightly outward at its front and rear edges, and has rounded corners. The forward end also curves upward in its front end F, like a ski tip, to keep it from poking into snow and to allow safe, sled-like running. The illustrated board is a unidirectional board; in bidirectional snowboards, both the front and rear tips are so curved, allowing the snowboarder to steer and slide in both forward and backward directions. In use, the rider stands on the board with his boots fastened at a central region, typically at the boot positions indicated by 2,4 in the FIGURE. As further shown in FIG. 1, strain actuators 20 are attached in the board near the edge, and in front of the forward boot position. The remainder of this description shall assume for clarity of exposition that the snowboard is a one-direction snowboard, that is with a curved tip ahead of the boots, so that the front lateral edges, i.e., the anterolateral edges, are the steering control edges that engage the terrain when steering is performed. Thus "front" shall refer to the forward end of the board, in its direction of travel. However, as will be apparent from the discussion below, the adaptation to bidirectional boards is contemplated, in which case a similar strain control structure may be provided at the rear lateral region in a position to control the edges which exert steering control during travel in the opposite direction. Thus "front" as used herein refers to the region between the boot position and an end of the board, whether front or back, when applied to such boards. A preliminary discussion will better elucidate the manner of construction of the device and positioning of components therein.

Figure 2:
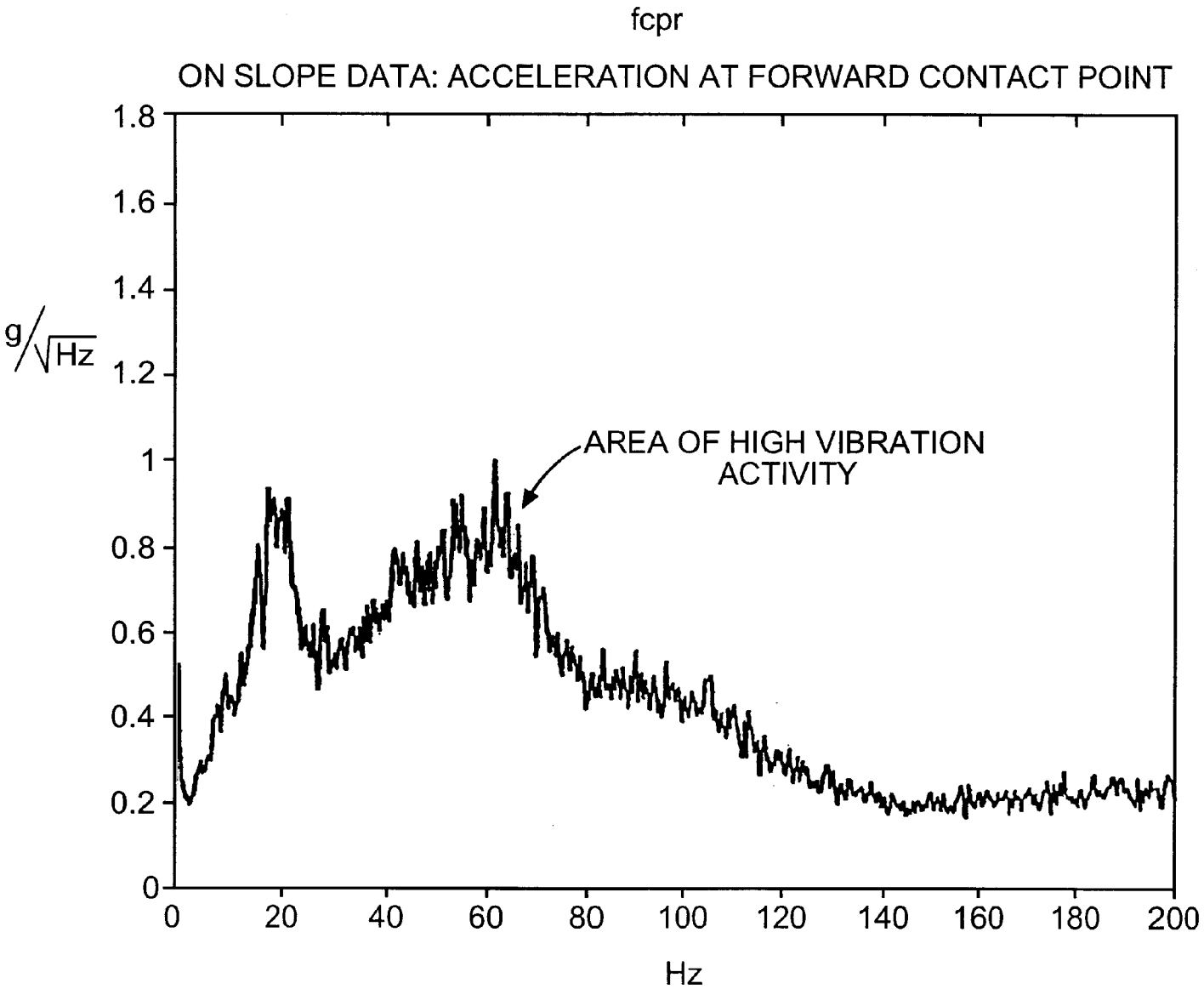
FIG. 2 is a graph illustrating vibrational energy in snowboard control regions in use.
Figure 3:
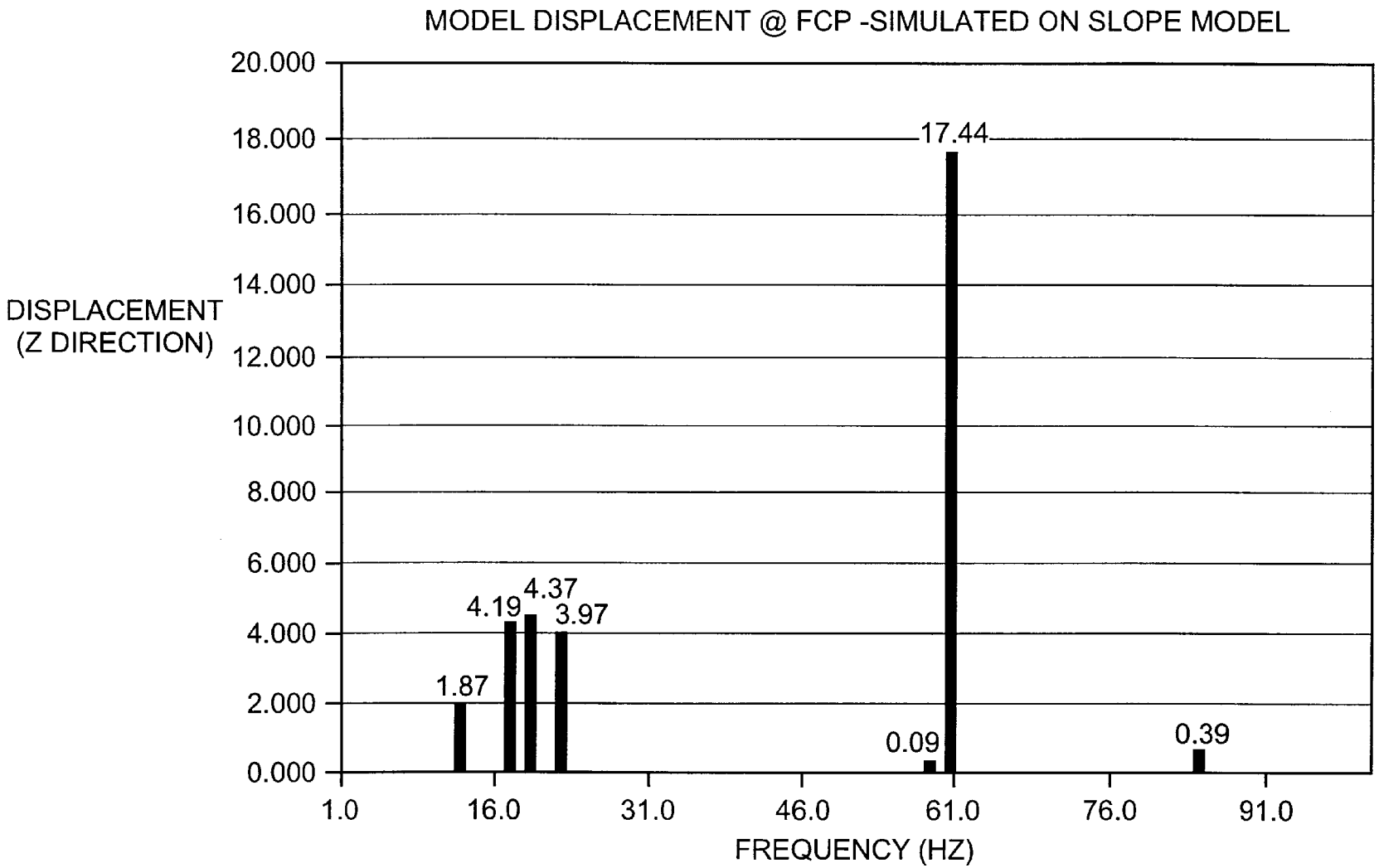
FIG. 3 plots modeled vibrational energy showing correlation with FIG. 2.

In general, the shape or exact edge contour of the present board may be the same as any board. Applicant sought to control plate vibration affecting board performance by using strain actuators in the board. In order to achieve an effective level of control, applicant first sought to determine the nature of the excitations arising in a snowboard in use. This was done by making a finite element model of the board as a mechanical plate system, determining actual board performance characteristics, and developing a strain element control structure to alter the operating characteristics. The evaluation of strain control effectioveness was then carried out by targeting particular a response and evaluating the effects achievable on that response. FIG. 2 illustrates a graph of acceleration as measured in the forward edges of a board during vigorous use on a slope. The acceleration was divided by the square root of frequency to obtain a measure of the power in each frequency, for the distribution over a band from zero to two hundred Hz. Higher frequency components, if present, were below the sensor noise level. The acceleration data was useful to help validate a model used to determine strain energy associated with active use of the board. As shown, the data exhibited a relatively narrow peak around twenty Hz, and a broader peak around sixty Hz. This data indicated a significant amount of power going in to an oscillatory displacement of the forward edges of the board. To better understand the nature of this spectrum, applicant established a model of the snowboard, and performed a finite element computer analysis of the board behavior. FIG. 3 illustrates the calculated z-axis (vertical) displacement for the modes of the device as experimentally determined in the laboratory and validated by the data measured in use on the ski slope. As shown, the disturbances correspond well to the original measurements, and contain relatively little power in the lower-frequency 20 Hz peak. Furthermore, the lower frequencies were believed to correspond to longitudinal modes of the board, which might have relatively little effect on the actual position of, or the performance effect exerted by, the forward control edges.

Figure 4:
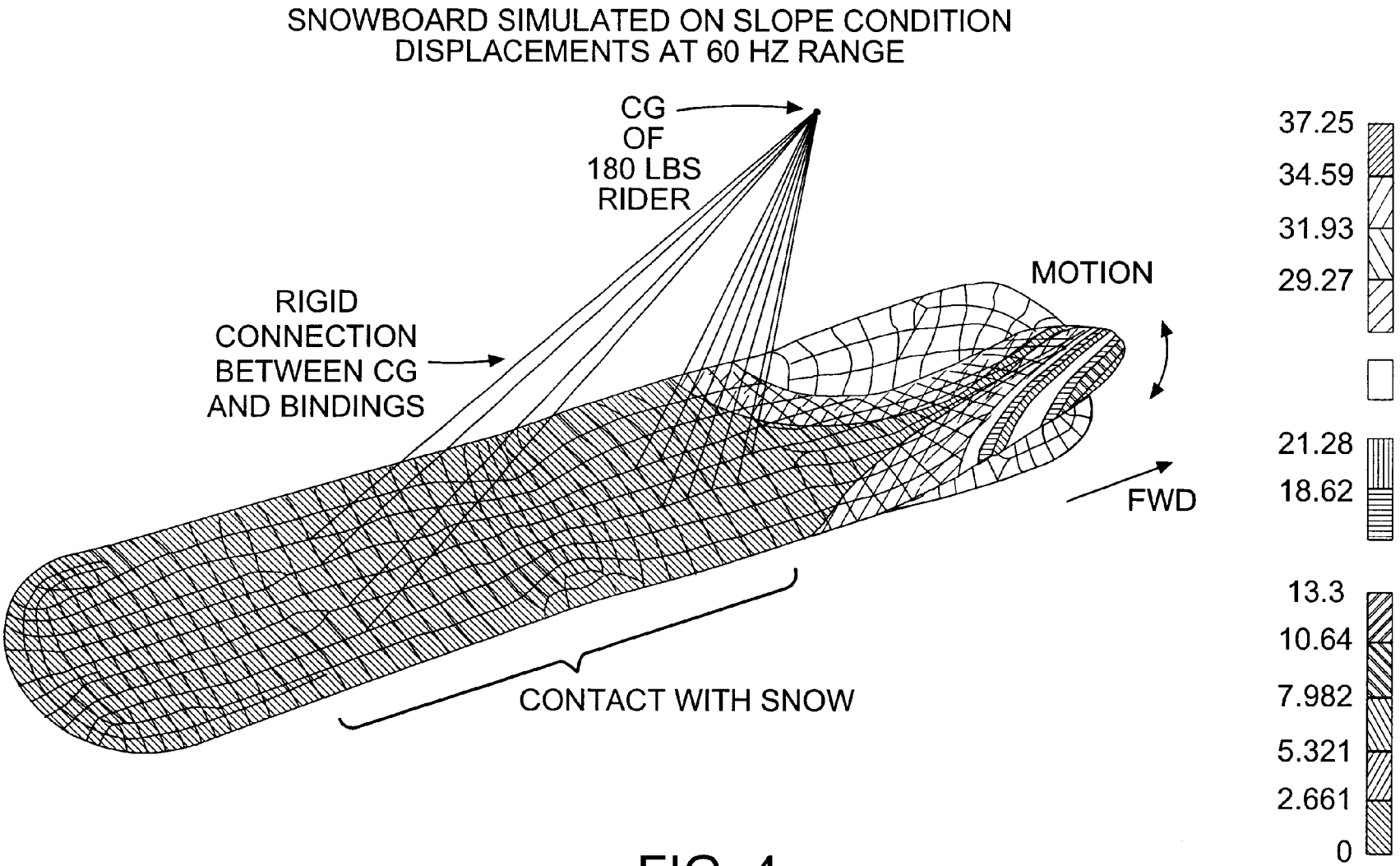
FIG. 4 illustrates steering edge loss of control during the vibrational states plotted in FIGS. 2 and 3.

By simulating the action of the observed behavior in a turning maneuver, applicant was able to further elucidate the details of performance. FIG. 4 shows a model of board behavior when a portion of the edge on one side of the board, the right side as shown, is constrained. The measurement condition simulated the effect as a rider executes a turn to the right side, forcing a major portion of the edge down into firm contact with the terrain. As shown by the gridwork of elements plotted about the tip region, the forward lateral edges then undergo relatively large vertical displacements. As shown, for the right edge, which is a bearing edge during the turn, a portion of the edge ahead of its front-most point of ground contact is displaced, while the left edge which is subject to less downward pressure undergoes displacements extending somewhat further back toward the boot support region. Moreover, this oscillatory movement is a torsional or torsion-like mode of the plate, in which a twist-like motion of the front occurs, resulting in a quickly changing displacement of the forward steering control edges. Several regions of high strain arise in the front left and right sides of the board, and the control edges chatter. Applicant sought to target this mechanical state by locating and controlling strain elements for reducing the strain energy in the board.

Figure 5:
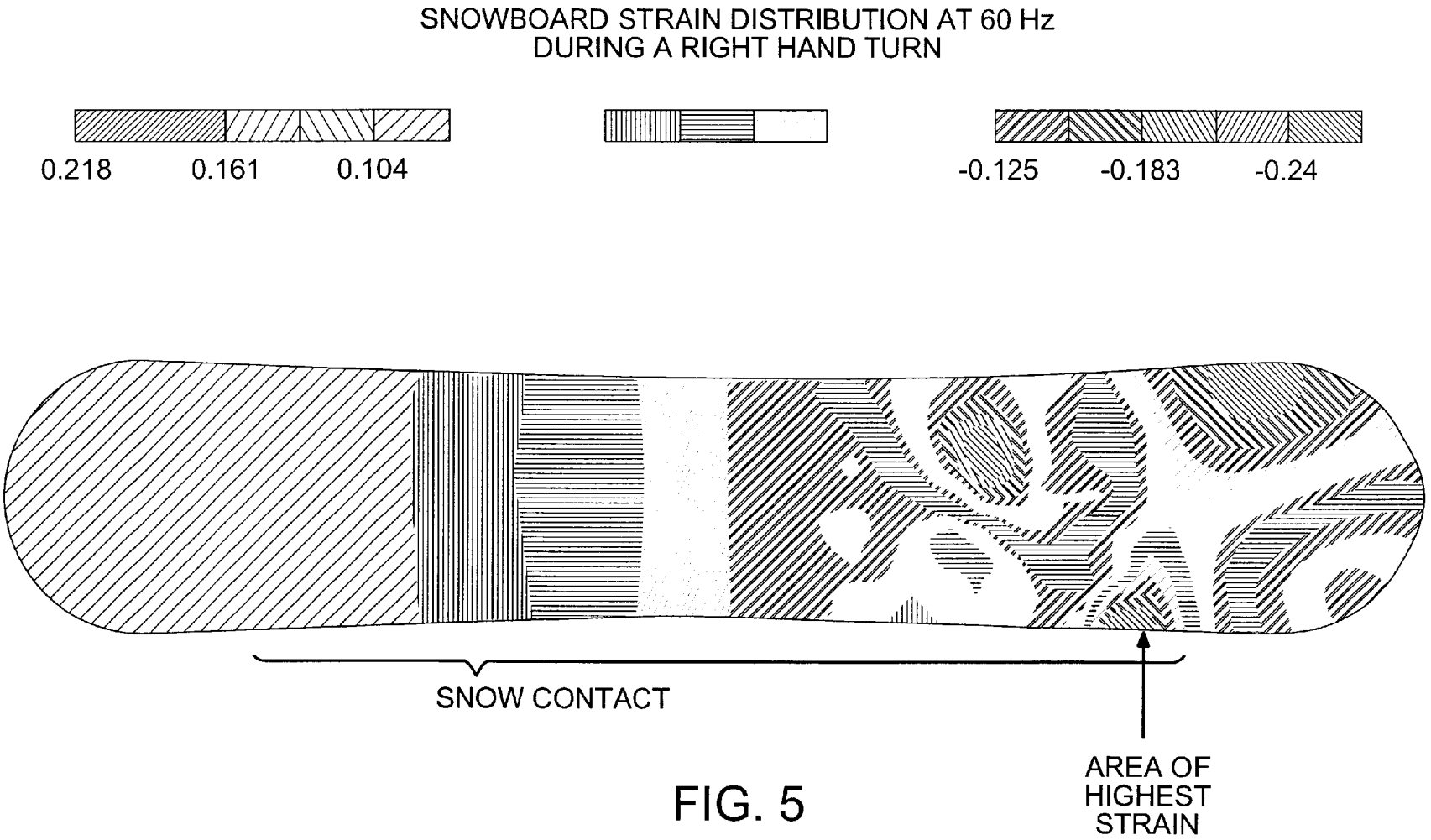
FIG. 5 plots strain distribution during a turning maneuver of the snowboard.
Figure 6:
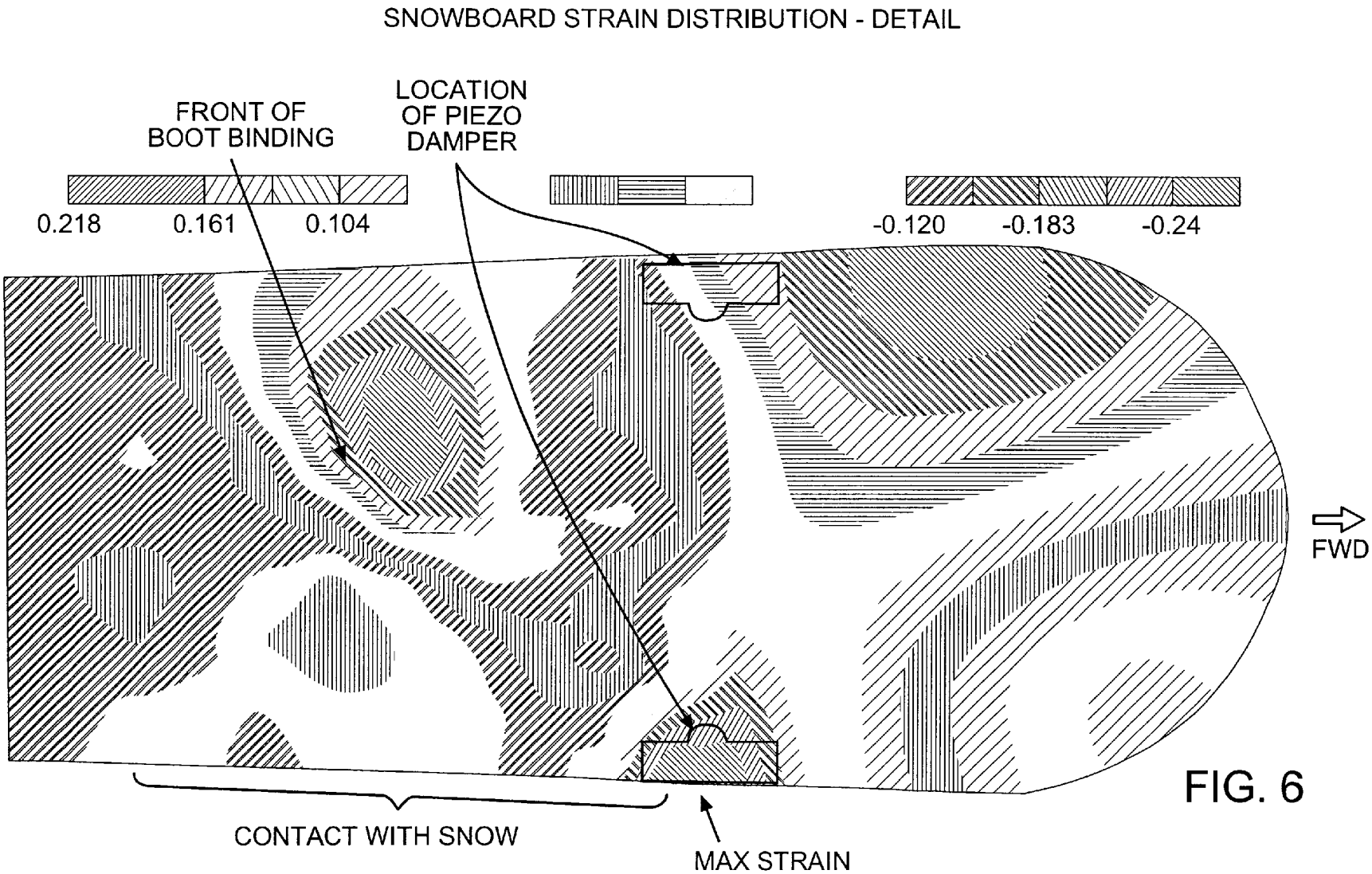
FIG. 6 shows details of control element positioning in relation to strain areas and structure of the board.

To reduce this objectionable behavior, applicant attached piezoelectric strain elements in the positions indicated by P in FIG. 1. These strain elements were then shunted so that the charge they generated, due to strain from the plate, oscillated at the resonance frequency of the targeted plate mode, resulting in a relatively high peak-to-peak voltage shunted across the elements. The charge was dissipated in a resistive element to mechanically counteract the disturbance. FIGS. 5 and 6 illustrate the distribution of strain energy in a snowboard due to the 60 Hz resonance during a right-hand turn. The level of strain is indicated by degree of shading over the fore region of the board. This was characterized by a region of highest strain near the leading contact point of the steering (right) edge, and two regions on the left side, a higher strain region near the boot and a region of moderately high strain nearer the tip. Thus, the asymmetric condition introduced by turning resulted in a distinctly localized pattern of strain at the front edges, with lower strain or nodal regions between these areas. A similar, but left-to-right reflected pattern of this distribution would be observed for a left-hand turn.

As shown in FIG. 4, during a right turn a central portion of the right edge adjacent the boot contacts the ground, while a forward region bordering the left edge undergoes displacement and a more forward region of the right edge and tip vibrates. This indicates a torsion-like oscillation of the snowboard body, with energy traveling back and forth between the flapping regions. Applicant sought to damp this behavior while not impairing the overall stiffness and flexibility of the board or adversely affecting its handling in other respects. To effectively counter this vibration during both left and right turns, applicant positioned strain material on both the left and right sides, near the edges and between the boot position and the end.

FIG. 6 indicates the location selected for positioning the strain elements in a prototype embodiment, and identifies the front binding position in relation to the strain distribution in the board. As shown, two sets of strain elements were used, and they were positioned near the left and right edges, respectively, so that one set lay in the region of highest strain for a right turn chatter mode, and the other was symmetrically placed in the region which would experience highest strain during a left-turn. A slight inset from the edge was used to reduce the likelihood of edge chipping or impact damage, and the region immediately adjacent the boot mount was also avoided to allow flexibility in positioning the boot mounts without risk of damaging a strain element. Furthermore care was taken to couple the strain elements closely to structural portions of the board, avoiding, for example, the tip region.

Figure 7:
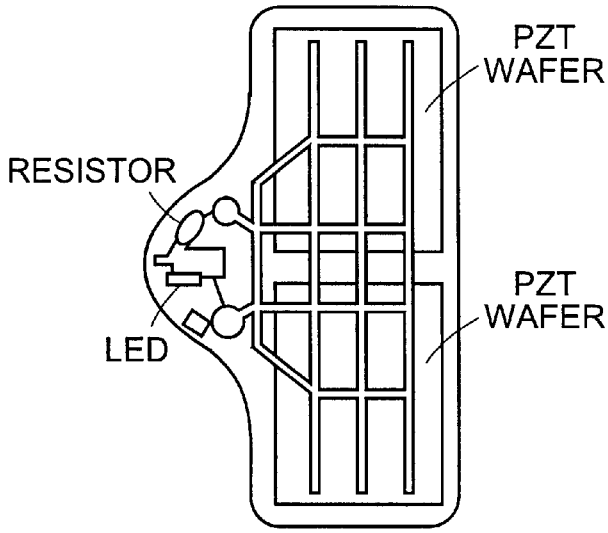
FIG. 7 illustrates a representative configuration of strain material for board control.

FIG. 7 shows the general shape and dimensions of a flat strain element assembly which was found to be effective. The assembly employed two sheet like bodies of PZT material arranged adjacent to each other end-to-end in a single layer, each body being about one half millimeter thick and about 4.5 by 3.5 centimeters in length and width. The piezo bodies were sintered sheets formed with a thin continuous metallization over both sides, and the sheets were electrically contacted by flex circuit sheets, to which they were attached in a way to assure a high degree of electrical contact, physical strengthening and mechanical strain transfer efficiency through to their contact surface with the snowboard. Lamination of the piezo and flex circuit under pressure was found to be effective to achieve these qualities. The strain assemblies were bonded to the surface in regions selected to effectively target a significant portion of strain energy in the snowboard, capturing about five percent of the strain energy. A shunt resistor of about 15 kΩ was placed across the strain elements so that together with the intrinsic capacitance of the elements they formed an R-C oscillator resonating at the target frequency. As further shown, an LED was mounted across the element and was powered by the charge produced therein, so that vibration of the snowboard and impacts thereto illuminated the LED and visibly indicated that the strain element package and its electrical connections were intact and functioning.

General technical considerations and a preferred methodology for fabricating or packaging the strain material are given in commonly-owned U.S. Pat. No. 5,656,882 which is a continuation of co-pending U.S. patent application Ser. No. 08/188,145 filed Jan. 27, 1994. Related details of construction and specific applications to damping of skis are described in co-pending U.S. patent application Ser. No. 08/536,067 filed on Sep. 29, 1995. Each of the foregoing patent applications and the foregoing patent are hereby incorporated by reference in their entirety herein.

For use in the present invention, separate actuator sheets complete with electrode connections and circuit elements may be fabricated according to the techniques of the aforesaid patent and patent applications, and then cemented onto, or bonded into the surface regions of the board during its manufacture. In particular, the sheet strain element assemblies may be prepackaged as described in the aforesaid patent and then either cemented or otherwise assembled in a subsurface or semi-submerged position in the board during board fabrication, or may be fabricated in situ during board manufacture. The body of piezo material may be continuous, such as a sintered continuous sheet or block, or may be a composite, for example, built up of a matrix material together with piezo fibers, either as relatively small or chopped fibers, or as longer, parallel oriented fibers to constitute an electroded actuation layer or body of the desired shape and strain characteristics. Other forms of composite, such as piezo flake or grain-filled matrix may also be used. Preferably, the piezo material is positioned adjacent to and is strain-coupled, i.e. stiffly connected, over its surface to a stiff or structural material layer of the board, rather than to the topmost graphic-bearing surface which may be a soft polymer incapable of effective strain energy coupling. In general, however, the elements extend over an area and are adjacent the surface in that they are on, in or under a region of the surface, and receive strain energy from that region.

Figure 7A:
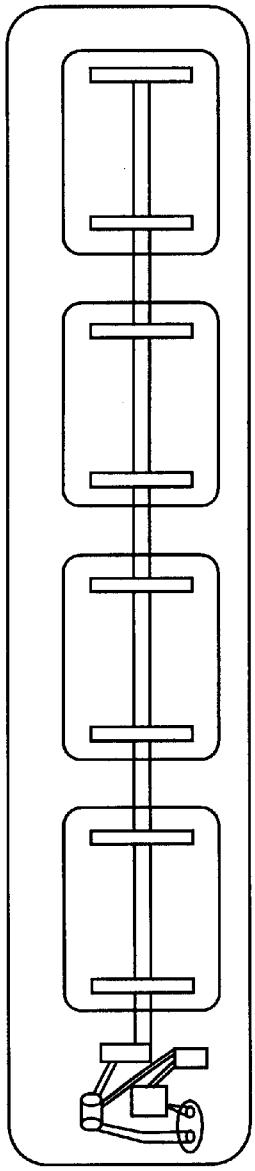
FIGS. 7A and 7B illustrate additional configurations of strain material for board control.
Figure 7B:
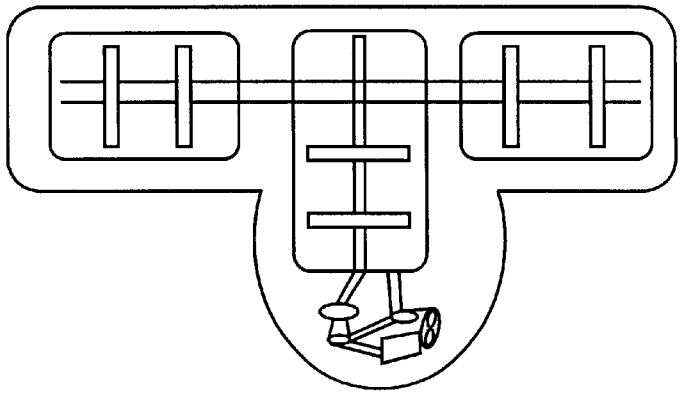

In fabricating the prototype board with PZT material, elements one half millimeter thick element were used so that the heavy elements in the piezoceramic would not introduce much added weight. The described embodiment involved only about forty grams of the overall weight of the board, which was several kilograms. In other embodiments the piezo elements may have greater area or thickness, and may be positioned to capture more strain energy. Thus, for example, damping assemblies may be laid out as shown in FIG. 7A or 7B to cover strip-like areas in various widths and lengths, or to cover a bulged strip that more effectively covers the small region of highest strain. While a larger area of strain material is capable of more effective strain dissipation, good damping with low weight was obtained in the prototype embodiment using the above-described strain assemblies covering a five by ten centimeter area aligned with the approximately ten centimeter long region of highest strain.

Figure 8:
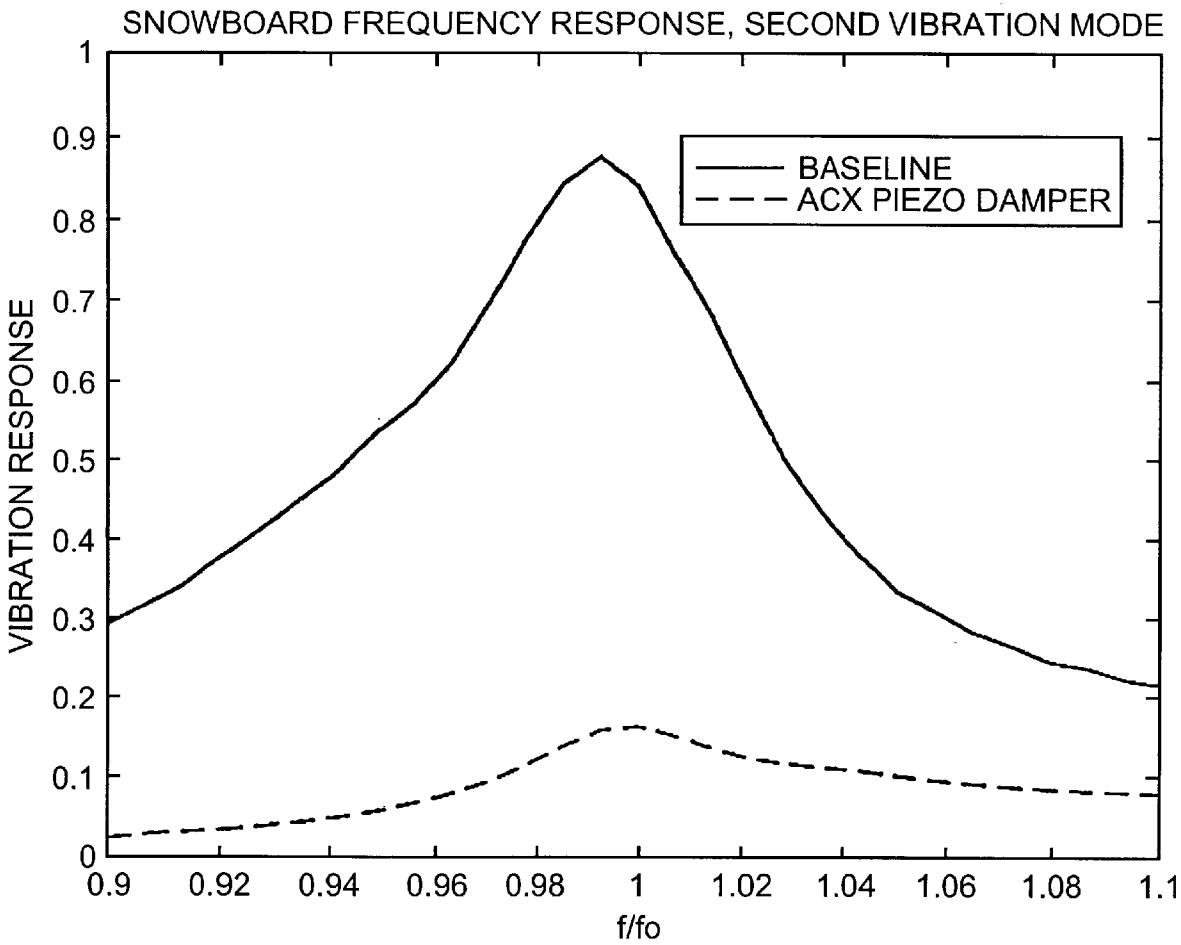
FIG. 8 graphs the control obtained in a prototype embodiment of the invention.

FIG. 8 illustrates the measured effect of the damping assembly of the present invention on the vibrational response of the prototype snowboard. The solid line plots the baseline vibratory response of the snowboard while a broad band disturbance was applied to the board. As shown, a conventional board exhibited only slightly damped behavior near the objectionable resonance $f_o$ (transfer function equal 0.9 at $f/f_o \sim 1$), while the shunted strain elements reduced the level of vibration to a low level. The piezoelectrically damped snowboard fabricated in this manner thus overcame the objectionable steering flutter of the unaltered board.

In building the prototype board, applicant sought to target a specific mid-frequency chatter of highest amplitude, and positioned a small number of strain elements to capture strain during left and right turning, using a tuned shunt to enhance effectiveness of the response to the chatter. However, additional sizes, numbers or shapes of piezo elements could also be used, and different shunts could be provided, such as an R-L shunt to more effectively impedance match to the strain material and to dissipate a greater amount of coupled energy, or dissipate it more quickly. Furthermore, different, e.g., multi-frequency or switched circuits could be employed to address different or additional excitation modes, and the invention further contemplates that a controller to provide active control signals may be mounted on the board. Commonly owned U.S. patent application Ser. No. 08/797,004 filed Feb. 7, 1997 describes further shunting and control constructions adaptable to the present invention. That patent application is hereby incorporated by reference herein in its entirety. In the protoype device discussed above, an R-C shunt was found effective to damp the higher amplitude 60 Hz mode that affected steering. However, with this chatter problem reduced or resolved, snowboard designers may also find it attractive to substitute stiffer material, or introduce larger or smaller platforms. In that case additional strain patterns may be exhibited in conditions of use and the placement of strain elements for these constructions would then be modified in accordance with the above described procedure and teachings of the present invention to damp these additional patterns.

This completes a basic description of the invention and a prototype snowboard with strain material incorporated to alter plate vibration of the device for more effective recreational control. However the invention is not intended to be limited to the particular device or construction shown. It may also be applied to bidirectional snow skis, various runnerless sled designs, and even the implementation of new shapes for such devices, as well as vibrational damping of devices formed with such new shapes, or with new materials. Furthermore, the invention is also considered to have application to other two-dimensional plate structures and recreational articles having similar responses, and may be adapted to water skis and to other devices having one or more bearing surface or edge portions, or having a comparable structure or facing a similar problem. The invention being thus disclosed and its operation described, variations and modifications thereof will occur to those skilled in the art, and all such variations and modifications are considered to be within the scope of the invention, as set forth in the claims appended hereto.

What is claimed is:

1. A snowboard comprising a generally elongated body extending over a two-dimensional region and having an upper surface, a lower surface and a support area located on the upper surface, said body extending forwardly and rearwardly from the support area to a bounding edge, and strain actuation material disposed in said body along a region thereof which is adjacent said upper surface and said bounding edge, and positioned at a forward region of the snowboard, said strain actuation material transducing strain energy to provide electrical energy at first and second conductors, and a circuit disposed across said first and second conductors for controlling said strain actuation material to stabilize the snowboard, wherein said strain material covers a surface region having an area greater than about ten square centimeters.

2. A snowboard according to claim 1, wherein said circuit for channeling electrical energy is a shunt.

3. A snowboard according to claim 2, wherein the shunt is tuned to a plate resonance of the snowboard.

4. A snowboard according to claim 3, wherein said strain actuation material is positioned and actuated to reduce amplitude of a torsional plate mode.

5. A snowboard according to claim 1, wherein said strain material is piezoceramic material mounted in a layer between upper and lower electrode traces, said traces being effective for conducting electricity to substantially all of said strain material in said region to establish a field across the thickness of the layer.

6. A snowboard according to claim 1, wherein said strain material comprises piezoelectric fibers.

7. A snowboard according to claim 6, wherein said fibers are oriented to preferentially damp longitudinal vibrations.

8. A snowboard according to claim 7, wherein said fibers are oriented to preferentially damp or shift vibrations oriented transverse to a fiber direction.

9. A snowboard according to claim 1, wherein said strain material comprises at least one piezoceramic sheet.

10. A snowboard according to claim 1, wherein said strain actuation material is positioned adjacent steering edges of the snowboard and electrically controlled to reduce chatter of said edges.

11. A snowboard comprising an elongated body extending over a generally oblong region for supporting a rider and sliding and steering along snowy terrain, wherein the snowboard includes strain actuation material positioned adjacent edges of the snowboard and a controller connected to the strain actuation material to damp a plate oscillation arising in said oblong region, wherein said strain actuation material covers a surface region having an area greater than about ten square centimeters.

12. A snowboard according to claim 11, wherein said controller includes a feedback circuit effective to selectively apply electric charge transduced by said strain actuation material from said plate oscillation.

13. A board comprising an elongated body extending over a generally oblong region for supporting a rider and sliding and steering over a surface, wherein the board includes strain actuation material for transducing strain energy to electric charge, and a circuit connected to the strain actuation material, said strain actuation material being positioned for effectively damping a plate oscillation of said oblong region, wherein said strain material covers a surface region having an area greater than about ten square centimeters.

14. A board according to claim 13, wherein the strain actuation material is substantially symmetrically located about an axis and disposed toward edges of said board.

15. A board according to claim 14, wherein the strain actuation material is embedded in said board.

16. A board according to claim 14, wherein the circuit passively controls the strain actuation material to damp a torsional chatter and stabilize a steering edge of said board.

* * * * *